United States Patent [19]

Jalbert et al.

[11] Patent Number: 4,513,518

[45] Date of Patent: Apr. 30, 1985

[54] SHOE INNER SOLE

[75] Inventors: Robert A. Jalbert, Swampscott; Anthony P. Galcenski, Jr., Groveland; Charles C. Urmson, Hingham, all of Mass.

[73] Assignee: Rogers Foam Corporation, Somerville, Mass.

[21] Appl. No.: 431,756

[22] Filed: Sep. 30, 1982

[51] Int. Cl.[3] ..... A43B 13/40; A43B 13/38

[52] U.S. Cl. ..... 36/44; 36/43; 128/619

[58] Field of Search ..... 36/44, 3 R, 3 B, 43; 128/588, 619, 622

[56] References Cited

U.S. PATENT DOCUMENTS

| | | | |
|---|---|---|---|
| 3,724,105 | 4/1973 | Weight | 36/44 |
| 3,730,169 | 5/1973 | Fiber | 36/44 |
| 3,828,792 | 8/1974 | Valenta | 128/619 |
| 4,232,457 | 11/1980 | Mosher | 36/44 |
| 4,237,627 | 12/1980 | Turner | 36/129 |

FOREIGN PATENT DOCUMENTS

| | | | |
|---|---|---|---|
| 1413280 | 4/1965 | France | 36/44 |
| 936975 | 11/1955 | United Kingdom | 36/44 |

*Primary Examiner*—Henry Jaudon
*Assistant Examiner*—Steven N. Meyers

[57] ABSTRACT

An inner sole with a cushioning layer of polyurethane foam, with compression set less than 10%, laminated to a thinner layer of thermoformable polyethylene foam, which serves primarily as a vehicle for shaping the polyurethane.

12 Claims, 6 Drawing Figures

SHOE INNER SOLE

BACKGROUND OF THE INVENTION

Separately-formed innersoles are often loosely inserted into athletic and other shoes. Some of these innersoles are thermoformed to the general shape of the foot and shoe, for better foot support. Others are simply flat sheets cut to shape. Sometimes a permanently-deformable material (i.e., one with a high compression set) is used to permanently conform the innersole to the user's foot during initial use. Sometimes a cushioning material (i.e., one with low compression set) is used to improve comfort.

Various materials and combinations of materials have been used to provide these properties. Microcell polyurethane foam, which exhibits a very low compression set (less than 10%), has been used to make flat, nonthermoformed innersoles with good cushioning (examples are those sold under the Dr. Scholl's trademark). Polyethylene foam has been used in thermoformed innersoles. Non-microcell polyurethane foam exhibiting a high compression set has been laminated with polyethylene foam to form a two-layer innersole in which the polyurethane layer has a high compression set to provide permanent deformation and in which the polyethylene layer is thicker than the polyurethane and provides cushioning.

SUMMARY OF THE INVENTION

In general the invention features an inner sole with a cushioning layer of polyurethane foam, with compression set less than 10%, laminated to a thinner layer of thermoformable polyethylene foam, which serves primarily as a vehicle for shaping the polyurethane. The invention thus combines the advantages of a shaped innersole with the cushioning advantages of microcell polyurethane.

In preferred embodiments, the polyurethane is a microcell foam and is the upper layer; a heel piece of microcell polyurethane is bonded below the polyethylene layer to form a three-layer structure in the vicinity of the heel; the polyethylene is thicker in the vicinity of the arch; the microcell polyurethane foam has a pattern of vertical holes to enhance foot breathing; the polyurethane foam is open cell; the polyethylene foam is closed cell; the polyurethane foam has a breakdown temperature below the temperature required for thermoforming the polyethylene foam; the polyurethane foam has a density greater than the density of the polyethylene foam and preferably in the range 2 to 20 lb/ft$^3$; the density of the polyethylene foam is preferably in the range 2 to 12 lb/ft$^3$; the polyurethane layer has a thickness in the range 0.05 to 0.17 inches; said polyethylene is adapted to compress during thermoforming to provide variation in thickness (e.g., thin at the forward end and thicker at the arch region); and the innersole is manufactured by separately heating the polyethylene layer to a temperature at which it can be thermoformed, then bonding the polyethylene to the unheated polyurethane, and finally thermoforming the bonded sandwich in a press, such that the polyurethane never reaches its breakdown temperature.

Other features and advantages of the invention will be apparent from the following description of the preferred embodiment and from the claims.

DESCRIPTION OF THE PREFERRED EMBODIMENT

Figure 1:
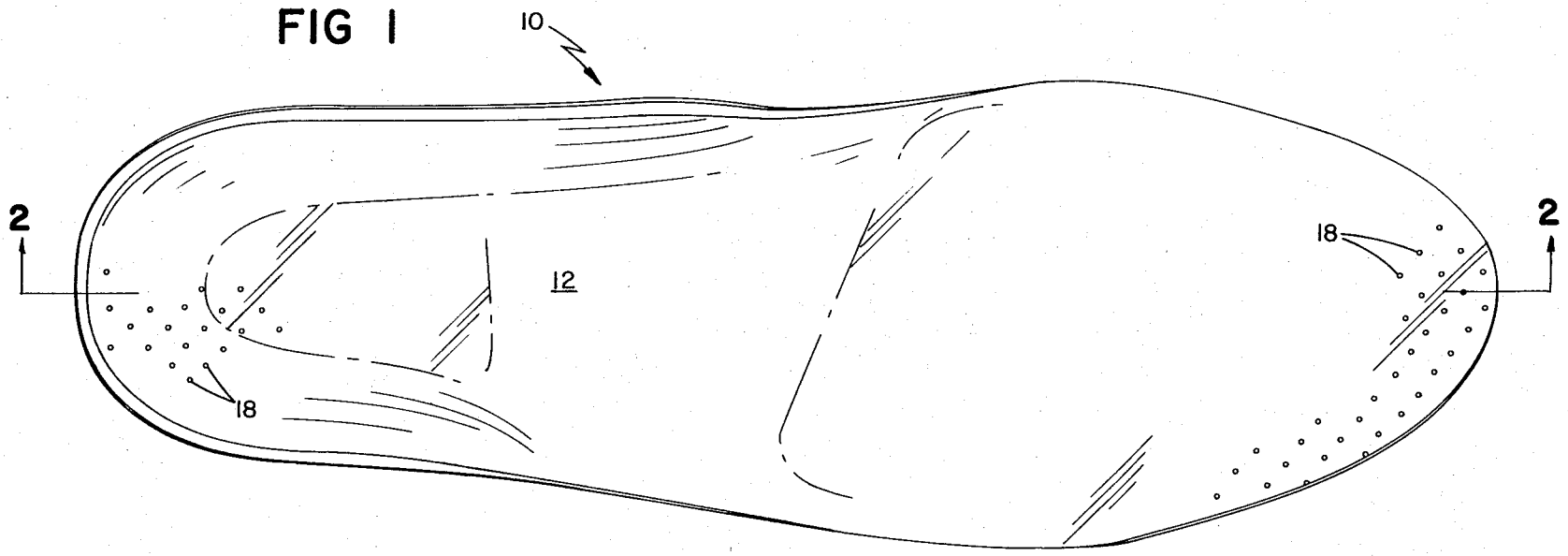
FIG. 1 is a plan view of the preferred embodiment.
Figure 2:
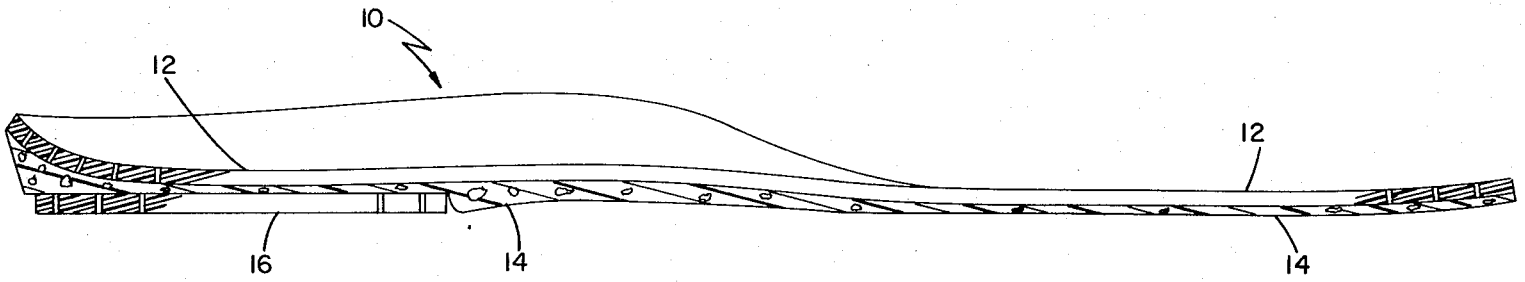
FIG. 2 is a cross sectional view taken at 2—2 in FIG. 1.
Figure 3:
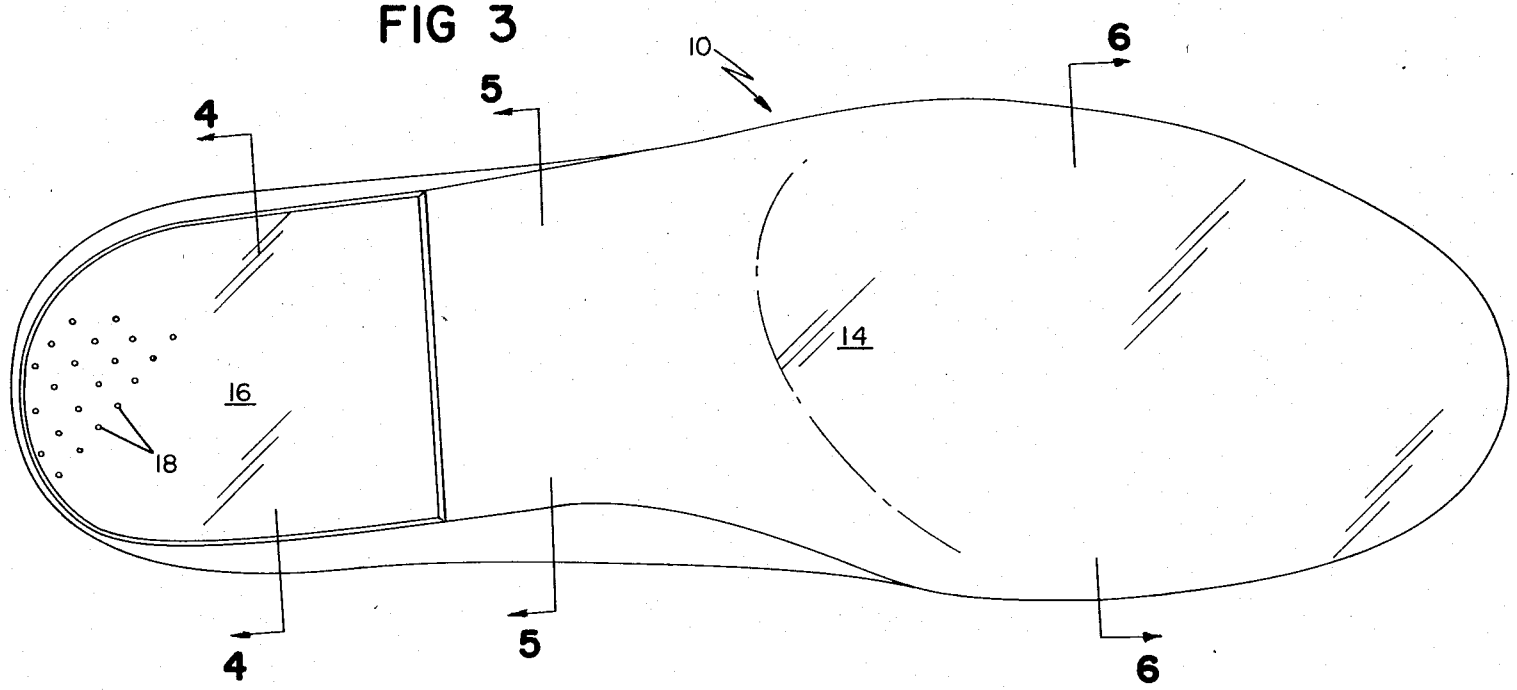
FIG. 3 is a bottom plan view of said embodiment.
Figure 6:
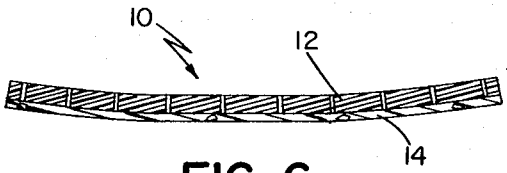
FIG. 6 is a cross sectional view taken at 6—6 in FIG. 3.
Figure 5:
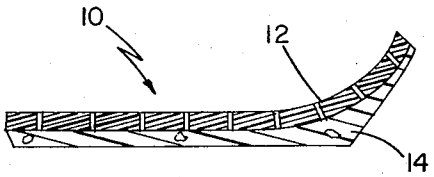
FIG. 5 is a cross sectional view taken at 5—5 in FIG. 3.
Figure 4:
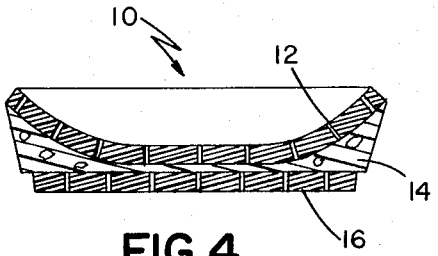
FIG. 4 is a cross sectional view taken at 4—4 in FIG. 3.

There is shown in the drawings an innersole 10 having an upper layer 12 of microcell polyurethane foam (Poron, manufactured by Rogers Corporation; density 17 lb/ft$^3$; compression set 5%) bonded by an adhesive (polychlorophene, American Finish Chemical Co., Chelsea, Mass., #E2084T) to a lower layer 14 of cross-linked polyethylene foam (density 4 lb/ft$^3$; compression set 15%). The Poron polyurethane foam has good cushioning characteristics (compressive load deflection characteristic: 12 to 20 psi when compressed to 25% of original thickness at a rate of 1 inch/minute). If other polyurethane foams are used they should preferably have a compressive load deflection characteristic in the range 5 to 25 psi when compressed 25% of original thickness at a 1/inch/minute rate. There is also a heel piece 16 of the same microcell polyurethane foam. The polyurethane is open cell and thus breathes; the polyethylene is closed cell. The polyurethane foam has a pattern of many small holes 18, each about 3/64 inch in diameter and arranged in a grid pattern with roughly $\frac{1}{4}$ inch spacing. The holes enhance foot breathing and also soften the layer to improve foot cushioning.

The polyethylene layer serves primarily as a vehicle for shaping the polyurethane layer, and thus it need not be as thick as the polyurethane, which is uniformly about 0.11 inches thick. The polyethylene layer is about 0.075 inches thick at the forward end of the innersole where it has been compressed considerably during thermoforming. At the arch and other areas the polyethylene layer is thicker.

To prevent breakdown of the polyurethane during thermoforming, the polyethylene is separately heated in an oven and bonded to the polyurethane just prior to insertion in the compression press. The breakdown temperature of the polyurethane (i.e., the maximum temperature to which it can be exposed for short intervals) is 250° F., which is less than the roughly 275° F. temperature to which the polyethylene must be elevated for thermoforming. While the polyethylene is being heated, the polyurethane is prepared for bonding by applying adhesive and drying the adhesive under heat lamps. The heated polyethylene and glue-bearing polyurethane are then bonded together and placed in a compression molding press. The heel piece, to which the same adhesive has been applied, is separately placed in the press. Water is used to cool the press and thereby reduce thermoforming time. After thermoforming, the innersoles are die cut to final size.

OTHER EMBODIMENTS

Other embodiments are within the following claims. For example, a polyethylene foam with high compression set (greater than 15%) could be used (possibly as the upper instead of lower layer) to provide foot conformance.

What is claimed is:

1. An innersole for athletic shoes and the like comprising a foot-cushioning layer of polyurethane foam, said polyurethane foam having a compression set of less than 10%, a layer of polyethylene foam bonded to said polyurethane layer, said polyethylene layer being thinner than said polyurethane layer, said polyethylene layer having been thermoformed and thereby given a nonuniform thickness, said polyurethane foam having a breakdown temperature below the temperature required for thermoforming said polyethylene layer, said polyurethane foam having a thickness unaltered by thermoforming, and said polyurethane foam being shaped by said thermoformed polyethylene layer.

2. The innersole of claim 1 wherein said polyurethane layer is the upper layer and further comprising a heel piece of microcell polyurethane foam bonded below said polyethylene layer so as to form a three layer structure in the vicinity of the heel.

3. The innersole of claim 2 wherein said polyethylene foam is thicker in the vicinity of the arch.

4. The innersole of claim 1 wherein said microcell polyurethane foam is the upper layer and includes a pattern of vertical holes to enhance foot breathing.

5. The innersole of claim 4 wherein said polyurethane foam is open cell.

6. The innersole of claim 1 wherein said polyethylene foam is closed cell.

7. The innersole of claim 1 wherein said polyethylene is cross-linked.

8. The innersole of claim 1 wherein said polyurethane foam has a density greater than that of said polyethylene foam.

9. The innersole of claim 8 wherein said polyurethane foam has a density in the range 2 to 20 $lb/ft^3$.

10. The innersole of claim 9 wherein said polyethylene foam has a density in the range 2 to 12 $lb/ft^3$.

11. The innersole of claim 10 wherein the thickness of said polyurethane layer is in the range 0.05 to 0.17 inches.

12. The innersole of claim 1 wherein the compressive load characteristic of the polyurethane foam is in the range of 5 to 25 psi when compressed 25% of original thickness at a rate of 1 inch/min.

* * * * *